US005545357A

United States Patent [19]

Radel et al.

[11] Patent Number: 5,545,357

[45] Date of Patent: Aug. 13, 1996

[54] CARBURETOR

[75] Inventors: Harry Radel, Geesthacht; Christian Vick, Stelle, both of Germany

[73] Assignee: Dolmar GmbH, Hamburg, Germany

[21] Appl. No.: 392,446

[22] Filed: Feb. 22, 1995

[30] Foreign Application Priority Data

Feb. 22, 1994 [DE] Germany ..... 94 02 870.2

[51] Int. Cl.[6] ..... F02M 17/04

[52] U.S. Cl. ..... 261/35; 261/DIG. 8; 261/DIG. 68

[58] Field of Search ..... 261/35, DIG. 68, 261/DIG. 8

[56] References Cited

U.S. PATENT DOCUMENTS

| | | | |
|---|---|---|---|
| 3,767,173 | 10/1973 | Ishii | 261/DIG. 68 |
| 4,810,427 | 3/1989 | Devine | 261/DIG. 68 |
| 4,824,613 | 4/1989 | Scott et al. | 261/DIG. 68 |
| 5,241,931 | 9/1993 | Radel | 261/DIG. 68 |

FOREIGN PATENT DOCUMENTS

| | | |
|---|---|---|
| 0464673A1 | 1/1992 | European Pat. Off. . |
| 4020947A1 | 1/1992 | Germany . |

OTHER PUBLICATIONS

JP-55-69748 A. Patent Abstracts of Japan, M-25, Aug. 9, 1980, vol. 4, No. 111.

*Primary Examiner*—Tim R. Miles
*Attorney, Agent, or Firm*—Townsend & Townsend and Crew

[57] ABSTRACT

To improve a carburetor including a main housing portion (12), in which a Venturi tube (2) and a throttling part (2a) are defined and which has an air intake side and an engine exit side, and a fuel pump (5) to the effect that, on the other hand a better starting procedure is provided and, on the other hand, the carburetor and, consequently, the engine are reliably prevented from getting flooded, it is suggested to supply fuel to the fuel pump (5) via a fuel intake (8) which is connected to the fuel tank (63) through a fuel line (64), and a fuel vapor supply (or vent) line (60) is provided which with its one end (61) is connected to the fuel intake feed channel (28) and with its other end (62) is connected to the fuel tank (63), and that in the route of the fuel vapor supply line (60) a check valve (66) is provided.

4 Claims, 1 Drawing Sheet

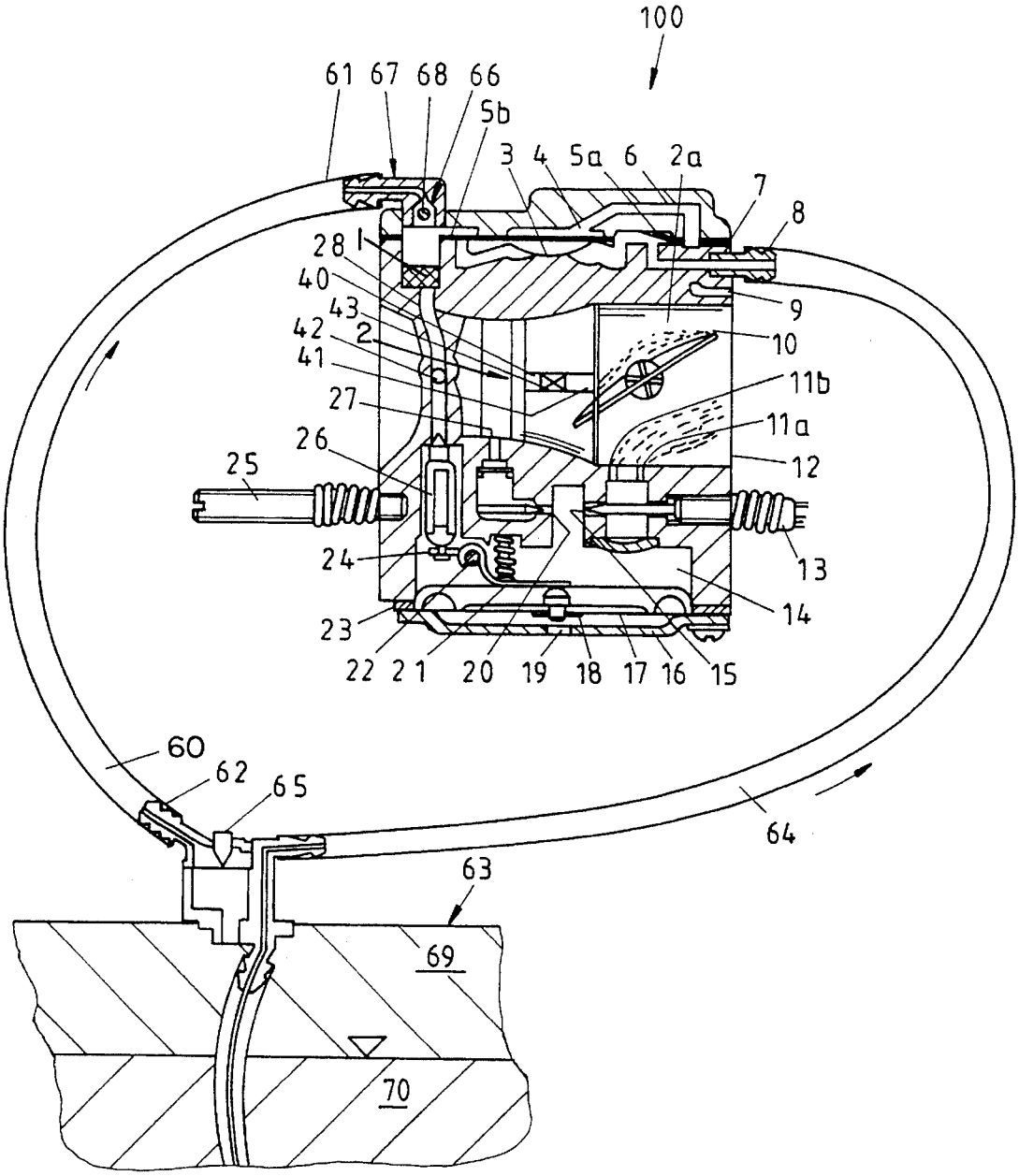
100
61
67
68
66
5b
3
4
5a
6
2a
7
8
28
40
43
42
2
41
27
26
25
24
23
22
21
20
19
18
17
16
15
14
13
12
11a
11b
10
9
60
62
65
64
63
69
70

CARBURETOR

BACKGROUND OF THE INVENTION

The invention relates to a carburetor including a main housing portion, in which a Venturi tube and a throttling port are defined and which has an air intake side and an engine exit side, which comprises a fuel pump, a fuel intake feed channel for supplying fuel from the fuel pump to a dosing chamber, a throttle valve arranged in the throttling port between the air intake side and the engine exit side, the dosing chamber for supplying fuel from the fuel pump into the Venturi tube or the throttling port through a main exit port and at least one slow-speed exit port. The main exit port at the air intake side of the throttle valve ends in said Venturi tube. The carburetor further includes: throttle supply passage which comprises an inlet port and an outlet port, the inlet port being in a direct fluidic connection with the fuel intake feed channel, the outlet port being in a direct fluidic connection with said throttling port and the inlet port being in a direct fluidic connection with said outlet port. A means for selectively opening and closing said throttle supply passage is typically provided, and the outlet of the throttle supply passage ends in upstream direction of the throttle valve, as is known from the EP 0 287 366 B1.

It has become known to provide a return fuel line which with its one end is connected to the fuel feed line and with its other end is connected to the fuel tank and including a throttle therebetween (EP 0 464 673 A1).

Such a carburetor, with or without a return fuel line which is provided with a flow resistance, typically cannot be combined with a closed pressure-sealed tank. Today, however, it is desirable and partly a condition of sale to provide a fuel tank that is impermeable to an efflux of gas (fuel-air mixture) in order to reduce the environmental load, especially also with respect to storing the device. For this purpose, the tank is manufactured so that it is completely closed and is only provided with a suction relief valve connected to the outside (atmosphere) which suction relief valve opens for allowing outer air to get in when taking fuel from the tank. However, when using such a closed tank, a flooding of the carburetor takes place in case of a temperature rise and a corresponding increase of pressure in the tank, if e.g. the needle valve of the diaphragm control does not close reliably or the choke valve is opened.

The direct lead of the fuel from the fuel intake feed channel to the Venturi or throttle valve area, with the control being opened, may very easily result in a flooding of the carburetor in case of a pressure build-up.

SUMMARY OF THE INVENTION

It, therefore, is the object of the invention to improve a carburetor of the type mentioned at the beginning so as to on the one hand provide a better starting procedure and on the other hand reliably prevent the carburetor and, consequently, the engine from getting flooded.

The basic concept of the present invention is to now provide a fuel tank ventilator line and to use the vent line as a fuel tank ventilator line. As a result of the double use of this line, there not only is achieved a structnral simplification but also a particularly advantageous operating performance.

In addition, a choke valve for selectively opening and closing the outlet port is provided as a means for selectively opening and closing the supply channel of the injection nozzle.

A carburetor equipped in such a manner leads to a substantially improved starting procedure of the engine. For starting, a tank ventilation takes place via the choke valve to be opened to the throttling port of the carburetor. An overpressure may have built up within the completely closed tank before starting, besides the air being visible above the fuel reflecting surface is interspersed with the volatile hydrocarbon in the vent line, too. Preferably, connection of the vent line is made so as to connect the highest point of the tank to the supply channel by means of the vent line functioning as a vent hose, with the engine being in a starting position. The actuation of a valve causes the excess pressure in the tank to drop through the injection nozzle which serves the delivery of the gaseous fuel vapor. Considering the fact that the throttle in the return fuel line provided for with known modifications is not used according to the inventive modification, a complete pressure drop can take place quickly. The starting procedure is immediately improved as a result of the presence of a gaseous fuel-air mixture.

According to this arrangement, an undesirable injection of the liquid fuel in consequence of the excess pressure in the tank is effectively impossible. In this way, a big quantity of fuel is not injected. A malfunction of the fuel pump in consequence of the tank ventilation is effectively impossible due to the return valve. According to the inventive arrangement, the return valve is opened as a result of the weight of the return ball as soon as the engine stops. The provision of the vent line, therefore, guarantees a substantially improved pressure release of the fuel pump while starting. A fuel feed causes the return valve to close. Irrespective of the pressure ratios available, this version enables the engine to start after 1–2 starting procedures already. Usually up to now: engines operate at 4–5 starting procedures for I-carburetor and 6–7 starting procedures for choke-valve carburetor.

BRIEF DESCRIPTION OF THE DRAWING

The drawing shows, in a perpendicular section, the carburetor and the fuel tank (partly) in an all-schematical view.

DESCRIPTION OF A SPECIFIC EMBODIMENT

The carburetor 100, shown in a section, of an internal combustion engine, not shown, comprises a housing 10, that is the main housing portion 12 of the carburetor, in which as a carbureting part the Venturi tube 2 and the subsequent throttle valve portion 2*a* including the throttle valve 10 are arranged. The fuel feed connecting sleeve 8 arranged in the fuel pump housing 6 is connected to a tank 63 through a fuel line 64 and is connected to the fuel feed line 7 in the carburetor, in which fuel feed line 7 a diaphragm pump chamber inlet valve 5*a*, a diaphragm pump 5 and a diaphragm pump outlet valve 5*b* are arranged one after the other. The fuel supplied by the fuel feed line 64 in the direction of arrow and entering the fuel chamber 3 through the fuel feed connecting sleeve 8 is pumped with pressure admission through the fuel intake feed channel 28 by the fuel pump 4 through the effective pump zone entering the pulse chamber 4 through the pulse channel 9 and acting upon the diaphragm, and is led from said fuel pump 4 through the filter sieve 1 to the needle valve 26 which is controlled by the control diaphragm 17.

The other component parts of the carburetor which are known per se are denoted by 11*a* - the primary low-speed outlet port, by 11*b* - the secondary low-speed outlet port, by 12 - the main housing portion of the carburetor, by 13 - the low-speed fuel adjusting means, by 14 - the dosing chamber, by 15 - the low-speed fuel adjusting port, by 16 - the diaphragm cover, by 17 - the dosing diaphragm, by 18 - the air chamber, by 19 - the air vent opening, by 20 - the main fuel adjusting port, by 21 - the inlet tension spring, by 22 - the rotary pin, by 23 - the diaphragm seal, by 24 - the inlet control lever, by 25 - the main fuel adjustment, by 26 - the inlet needle, by 27 - the main outlet port and by 28 - the fuel intake feed channel.

Furthermore, a throttle supply passage 40, which is connected to the fuel intake feed channel 28 at the inlet port 42, extends from the fuel intake feed channel 28 into the throttling port 2*a*. Said throttle supply passage 40 is provided within a fixed portion of the carburetor housing.

The throttle supply passage 40 comprises an opening 41 which is provided at the air intake side of the throttling port 2*a*. Furthermore, a facility 43 roughly indicated in the drawing is provided for selectively opening and closing the throttle supply passage 40 which is an On/Off valve mechanism and is described as a choke valve.

The throttle valve 10 is partly but not completely opened when the engine is started and the throttle supply passage 40 is opened.

The engine vacuum, while starting the engine not shown in the drawing, is carried to the dosing chamber 14 through the low-speed exit ports 11*a* und 11*b* which at the fuel side 14 of the diaphragm 17 generate a low pressure. The air pressure in the chamber 18 forces the diaphragm 17 upwardly for the purpose of opening the inlet needle 26. This enables the fuel to enter the dosing chamber 14 and, thereafter the Venturi tube 2/throttling port 2*a* through the opening 15 and the low-speed exit ports 11*a* and 11*b* to get to the engine. Besides, fuel is injected under pressure by the fuel pump 5 into the throttling port 2*a* through the throttle supply passage 40 from the fuel intake feed channel 28. As soon as the engine has reached its operating temperature the carburetor is operated in the usual way by opening the throttle valve 10 and closing the throttle supply passage 40 at the same time to cause the main exit port 27 to go into effect.

The choke valve 43 is opened to facilitate and improve this starting procedure so as to allow a fuel-air mixture 69 containing especially volatile hydrocarbons to get into the carburettor which simplifies the starting procedure significantly. Thereat the excess pressure of the gas-air mixture 69 above the fuel 70 is reduced through the vent line 60 into the carburetor in the direction of arrow and through the injection nozzle 41, i.e. a corresponding mixture is injected or blown into the throttling port 2*a*.

The vent line 60, which with its one end 61 is connected to the fuel tank 63 in the area of the suction relief valve 65, with its other end 62 is connected to the fuel intake feed channel 28 at the connection point 67 through a reverse-flow preventing check valve. The check valve 66 comprises a valve body 66 defined as a floating body which floats on the surface and locks the check valve 66 as soon as the fuel enters.

We claim:

1. A carburetor for an engine having a fuel tank and a fuel line comprising:

a main housing defining a Venturi tube, a dosing chamber, a main exit port, an idle exit port and a throttling port, the main housing having an air intake side and an engine exit side;

a fuel pump disposed within the main housing;

a fuel intake feed channel for supplying fuel from the fuel pump to the dosing chamber, the dosing chamber being coupled to the Venturi tube via the main exit port and the idle exit port;

a throttle valve disposed in the throttling port between the air intake and engine exit sides of the main housing, the main exit port at the air intake side of the throttle valve ending in the Venturi tube;

a throttle supply passage having an inlet port in fluid communication with the intake feed channel and an outlet port in fluid communication with the throttling port and the inlet port, the outlet port ending in an upstream direction from the throttle valve;

a valve for selectively opening and closing the throttle supply passage;

a fuel intake adapted for coupling to the fuel line of the fuel tank for supplying fuel to the fuel pump;

a vent line having a first end coupled to the fuel intake feed channel and a second end adapted for coupling to the fuel tank; and a check valve disposed along the vent line between the first and second ends for at least inhibiting fluid flow from the vent line into the intake feed channel.

2. The carburetor of claim 1 wherein the vent line is coupled to the main housing at a connection point vertically spaced above the intake feed channel, the check valve being arranged directly on the main housing at the connection point.

3. The carburetor of claim 1 wherein the check valve comprises a valve body which is defined as a floating body.

4. An improvement to a carburetor for an engine having a fuel tank and a fuel line, the carburetor comprising a main housing defining a Venturi tube, a dosing chamber, a main exit port, an idle exit port and a throttling port, a fuel pump disposed within the main housing, and a fuel intake feed channel for supplying fuel from the fuel pump to the dosing chamber, the dosing chamber being coupled to the Venturi tube via the main exit port and the idle exit port, the improvement comprising;

a vent line having a first end coupled to the fuel intake feed channel and a second end adapted for coupling to the fuel tank; and a check valve disposed along the vent line between the first and second ends for at least inhibiting fluid flow from the vent line into the intake feed channel.

* * * * *